US007367464B1

(12) United States Patent
Agostini et al.

(10) Patent No.: US 7,367,464 B1
(45) Date of Patent: May 6, 2008

(54) PENDULATION CONTROL SYSTEM WITH ACTIVE RIDER BLOCK TAGLINE SYSTEM FOR SHIPBOARD CRANES

(75) Inventors: Michael J. Agostini, Newton Center, MA (US); J. Dexter Bird, III, Hampton, VA (US); Jeffrey P. Green, Germantown, MD (US); Frank A. Leban, Columbia, MD (US); Gordon G. Parker, Houghton, MI (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 11/700,973

(22) Filed: Jan. 30, 2007

(51) Int. Cl.
*B66C 23/53* (2006.01)

(52) U.S. Cl. ..... 212/308; 254/900

(58) Field of Classification Search ..... 212/308; 254/900

See application file for complete search history.

(56) References Cited

U.S. PATENT DOCUMENTS

| | | | |
|---|---|---|---|
| 4,009,843 | A | 3/1977 | Gomez |
| 4,009,844 | A | 3/1977 | Gomez |
| 4,083,510 | A | 4/1978 | Gomez |
| 4,157,812 | A | 6/1979 | Bennett |
| 4,171,053 | A | 10/1979 | Cecce |
| 4,932,541 | A | 6/1990 | Belsterling |
| 5,089,972 | A | 2/1992 | Nachman et al. |
| 5,160,286 | A | 11/1992 | Hill |
| 5,297,019 | A | 3/1994 | Zuehlke |
| 5,511,268 | A | 4/1996 | Albus et al. |
| 5,526,946 | A | 6/1996 | Overton |
| 5,785,191 | A | 7/1998 | Feddema et al. |
| 5,908,122 | A | 6/1999 | Robinett, III et al. |

(Continued)

FOREIGN PATENT DOCUMENTS

GB 2096563 A 10/1982

(Continued)

OTHER PUBLICATIONS

Michael J. Agostini, Gordon G. Parker, Kenneth Groom, Hanspeter Schaub and Rush D. Robinett, "Command Shaping and Closed-Lop Control Interactions for a Ship Crane," Proceedings of the American Control Conference, Anchorage, Alaska, May 8-10, 2002, pp. 2298-2304.

(Continued)

*Primary Examiner*—Thomas J. Brahan
(74) *Attorney, Agent, or Firm*—Howard Kaiser

(57) ABSTRACT

The inventive control system, as typically embodied, includes sensing mechanisms, a computational processing unit, and an algorithm for processing inputs and generating outputs to control a rotating pedestal crane equipped with a Rider Block Tagline System (RBTS). Typical inventive embodiments uniquely feature a processing algorithm that distributes various control modes that operate not only through the crane's hoisting, luffing, and slewing mechanisms but also through the crane's RBTS; the inventive algorithm thereby effectuates motion compensation and pendulation damping with respect to the crane. This algorithmic allocation of control represents a more efficient crane anti-pendulation methodology than conventional methodologies; in particular, the inventive methodology exerts significantly greater control of the payload while exacting significantly less burden upon the hoisting, luffing, and slewing mechanisms of the crane.

10 Claims, 8 Drawing Sheets

U.S. PATENT DOCUMENTS

| | | | |
|---|---|---|---|
| 5,961,563 | A | 10/1999 | Overton |
| 6,039,193 | A | 3/2000 | Naud et al. |
| 6,439,407 | B1 | 8/2002 | Jacoff et al. |
| 6,442,439 | B1 | 8/2002 | Robinett, III et al. |
| 6,496,765 | B1 | 12/2002 | Robinett, III et al. |
| 6,505,574 | B1 | 1/2003 | Naud et al. |
| 6,566,834 | B1 | 5/2003 | Albus et al. |
| 6,631,300 | B1 | 10/2003 | Nayfeh et al. |
| 6,644,486 | B2 | 11/2003 | Jacoff et al. |
| 6,826,452 | B1 | 11/2004 | Holland et al. |
| 7,044,314 | B2 | 5/2006 | Nayfeh et al. |
| 2002/0144967 | A1 | 10/2002 | Jacoff et al. |
| 2004/0073343 | A1 | 4/2004 | Nayfeh et al. |

FOREIGN PATENT DOCUMENTS

| | | | |
|---|---|---|---|
| GB | 2150516 | A | 7/1985 |
| GB | 2267360 | A | 1/2003 |

OTHER PUBLICATIONS

Michael J. Agostini, Gordon G. Parker, Hanspeter Schaub, Kenneth Groom and Rush D. Robinett, "Generating Swing-Suppressed Maneuvers for Crane Systems with Rate Saturation," IEEE Transactions on Control Systems Technology, vol. 11, No. 4, Jul. 2003, pp. 471-481.

W. Thomas Zhao and Frank Leban, "Human/Hardware-in-the-Loop Testbed of Cargo Transfer Operations at Sea," ASNE (American Society of Naval Engineers) Joint Sea Basing Conference, Arlington, Virginia, Jan. 27-28, 2005, 10 pages.

William Palmer, "Open-Ocean and At-Anchor Testing Supports Seabasing Initiatives," Wavelengths Online, posted online Mar. 23, 2004, Naval Surface Warfare Center, Carderock Division, http://www.dt.navy.mil/wavelengths/archives/000050.html, printed out Jul. 5, 2006.

Gordon G. Parker, "Experimental Verification of a Command Shaping Boom Crane Control System," Proceedings of the American Control Conference, San Diego, California, Jun. 1999.

Ali H. Nayfeh and Ziyad N. Masoud, "A Supersmart Controller for Commercial Cranes," *IASC Newsletter*, International Association for Structural Control, vol. 6, No. 2, Nov. 2002, pp. 1-6 (Article appears on pp. 4-6).

PENDULATION CONTROL SYSTEM WITH ACTIVE RIDER BLOCK TAGLINE SYSTEM FOR SHIPBOARD CRANES

STATEMENT OF GOVERNMENT INTEREST

The invention described herein may be manufactured and used by or for the Government of the United States of America for governmental purposes without payment of any royalties thereon or therefor.

BACKGROUND OF THE INVENTION

The present invention relates to cranes, more particularly to methodologies for controlling pendulation that is associated with motion of suspended payloads during operation of cranes, such as rotary boom (slewing pedestal) cranes mounted aboard ships for transferring cargo to piers or other ships.

Crane technology is prevalent in a variety of settings for effecting lift-on, lift-off transfer of cargo. A "gantry crane" implements a horizontally moveable trolley from which a payload is suspended. A "slewing pedestal crane" (also commonly referred to as a "rotary boom crane" or a "rotary jib crane") involves the suspension of a payload from the tip of a rotatable "boom" ("jib"). According to a "simple" type of slewing pedestal crane, a payload hoist line extends between the boom tip and the payload. The operator of a simple type of slewing pedestal crane is challenged with the task of manually controlling the crane in three degrees-of-freedom, viz., slew (horizontal rotational motion of the boom that results in translation of the payload in a direction transverse to the orientation of the jib), luff (vertical rotational motion of the boom that results in translation of the payload in a direction parallel to the orientation of the jib), and hoist (vertical translation of the payload).

Known in the art is a type of slewing pedestal crane that incorporates a so-called "Rider Block Tagline System" ("RBTS"). An RBTS-equipped crane includes a boom, a rider block (which is situated generally intermediate the boom tip and the payload), a rider block lift line (which extends between the boom tip and the rider block), a payload hoist line (which extends between the boom tip and the payload and is reeved through the rider block), a left tagline, and a right tagline. An RBTS-equipped type of slewing pedestal crane, more complicated than a simple type of slewing pedestal crane, is characterized by the three aforementioned degrees of freedom plus two additional degrees of freedom, viz., the vertical and horizontal positions of the rider block. Due to its greater complexity as compared with a simple slewing pedestal crane, an RBTS-equipped slewing pedestal crane demands greater dexterity and decision-making from the crane operator. Of particular note, the crane operator is required to maintain the rider block within a "feasibility region" in three-dimensional space in order to maintain operability of the RBTS-equipped crane.

The complexity of operating an RBTS-equipped slewing pedestal crane can be alleviated in a manner such as disclosed by Naud et al. U.S. Pat. No. 6,039,193 issued 21 Mar. 2000, entitled "Integrated and Automated Control of a Crane's Rider Block Tagline System," incorporated herein by reference. Naud et al.'s automatic control of the RBTS is "integrated" with the RBTS-equipped crane so as to, in effect, reduce the number of degrees-of-freedom confronting the crane operator from five degrees-of-freedom to the three degrees-of-freedom that characterize a simple slewing pedestal crane. According to Naud et al., automated control is exercised with respect to the vertical and horizontal positions of the rider block. The method of Naud et al. includes generating a matrix defining incremental changes of the rider block's position in the context of a coordinate system, providing a vector defining velocity criteria for the rider block, multiplying the vector by an inversion of the matrix to obtain a control matrix defining speed and direction of travel for the rider block lift line and the taglines, and controlling movement of the rider block lift line and the taglines using the control matrix.

The RBTS was developed by the U.S. Navy in the mid-1970s to improve the capability of conventional lattice-boom construction cranes for use in container-handling operations in an offshore environment. An important motivation for the U.S. Navy in this regard was to seek to mitigate "pendulation" associated with cargo handling at sea. The principle pendulation-mitigating feature of the RBTS is the presence of a rider block, which serves to effectively reduce the pendulum length to that portion of the hoist line that is between the rider block and the payload. Such pendulum length reduction tends to increase the payload's oscillatory frequency, thereby preventing the entrainment of the payload's oscillation with respect to the oscillation characterizing the ship's motion. Pendulation—swinging or swaying of the payload attached to one or more hoist lines—is a fundamental problem associated with control of a slewing pedestal crane. Crane operators usually seek to avoid or minimize pendulation.

The following paper, which discloses a Pendulation Control System (PCS) for a simple type of ship-based rotary crane, is incorporated herein by reference: Michael Agostini, Gordon G. Parker, Kenneth Groom, Hanspeter Schaub and Rush D. Robinett, "Command Shaping and Closed-Loop Control Interactions for a Ship Crane," Proceedings of the American Control Conference, Anchorage, Ak., 8-10 May 2002, pages 2298-2304. According to the methodology disclosed by Agostini et al. 2002, a payload mass is conceived to swing on the end of a spherical pendulum that includes a payload hoist line, which is attached to a boom, which is attached to a rotatable column having a geometric axis that is perpendicular to the deck of a ship. The crane has three degrees-of-freedom, viz., slew, luff and hoist. The perpendicular column can be rotated clockwise or counter-clockwise; this is referred to as "slewing." The boom can be rotated to elevate or lower the tip of the boom, thereby positioning the payload closer to or farther from the crane column; this is referred to as "luffing." The length of the payload hoist line can be lengthened or shortened; this is referred to as "hoisting." The crane operator positions the payload by issuing luff, slew and hoist commands in real time.

Agostini et al. 2002's control strategy for mitigating pendulation combines three controllers that interact with each other, viz., a command shaper, a ship motion compensator, and a swing damper. The command shaper filters ("shapes") the operator's commands, preventing the inadvertent addition thereby of energy to the system. The ship motion compensator compensates for sea-induced crane base motion by isolating energy; it prevents transmission of energy from the sea into the payload. An inertial measuring unit can be situated on the ship to measure the sea-induced crane base motion in terms of six degrees-of-freedom, viz., roll, pitch, yaw, heave, surge, and sway. The swing damper compensates for external swing disturbances by introducing slew, luff, and hoist commands that tend to null a pendulation error signal generated by a pendulation sensing mechanism and summed to an internally generated "nominal"

pendulation value; it removes energy that has entered the system from external sources (e.g., wind) or from system nonlinearities. The pendulation sensing mechanism must be capable of resolving the position of the payload in a frame of reference fixed to the boom and oriented to the local gravity vector. One means of effecting a solution is via a sensor situated at the upper end of the payload hoist line attached to the boom tip to provide swing angle feedback.

Also of interest regarding PCS are: W. Thomas Zhao and Frank Leban, "Human/Hardware-in-the-Loop Testbed of Cargo Transfer Operations at Sea," ASNE (American Society of Naval Engineers) Joint Sea Basing Conference, Arlington, Va., Jan. 27-28, 2005, 10 pages, incorporated herein by reference; and, Robinett, III et al. U.S. Pat. No. 6,442,439 B1 issued 27 Aug. 2002, entitled "Pendulation Control System and Method for Rotary Boom Cranes," incorporated herein by reference. The pendulation control system of Robinett, III et al. '439, which pertains to the command shaping aspect of the Pendulation Control System disclosed by Agostini et al 2002, includes an input command sensor, a pendulation frequency identifier, and a command shaping filter. In a simple type of slewing pedestal crane, the input command sensor responds to the operator commands from the operator input device, and the input commands are thus filtered so as to reduce pendulation. The pendulation frequency identifier indicates the residual payload pendulation frequency of the crane. The command shaping filter filters out the residual payload pendulation frequency from the operator commands.

Other electromechanical and/or algorithmic approaches have been considered for assisting crane operators in controlling slewing pedestal cranes. See, for instance, the following United States patents, each of which is incorporated herein by reference: Nayfeh et al. U.S. Pat. No. 6,631,300 B1 issued 7 Oct. 2003, entitled "Nonlinear Active Control of Dynamical Systems"; Naud et al. U.S. Pat. No. 6,505,574 B1 issued 14 Jan. 2003, entitled "Vertical Motion Compensation for a Crane's Load"; Robinett, III et al. U.S. Pat. No. 6,496,765 B1 issued 17 Dec. 2002, entitled "Control System and Method for Payload Control in Mobile Platform Cranes"; Jacoff et al. U.S. Pat. No. 6,444,486 B2 issued 11 Nov. 2003, entitled "System for Stabilizing and Controlling a Hoisted Load"; Jacoff et al. U.S. Pat. No. 6,439,407 B1 issued 27 August 2002, entitled "System for Stabilizing and Controlling a Hoisted Load"; Overton et al. U.S. Pat. No. 5,961,563 issued 5 Oct. 1999, entitled "Anti-Sway Control for Rotating Boom Cranes"; Robinett, III et al. U.S. Pat. No. 5,908,122 issued 1 Jun. 1999, entitled "Sway Control Method and System for Rotary Boom Cranes"; Nachman et al. U.S. Pat. No. 5,089,972 issued 18 Feb. 1992, entitled "Moored Ship Motion Determination System." See also, Bonsor et al. United Kingdom Patent Application GB 2267360 A published 12 Jan. 2003, entitled "Method and System for Interacting with Floating Objects," incorporated herein by reference.

Generally speaking, control systems and methods known in the art for facilitating crane operation are not entirely successful in limiting or alleviating pendulation to acceptable magnitudes under all standard operating conditions.

SUMMARY OF THE INVENTION

In view of the foregoing, it is an object of the present invention to provide improved system and method for promoting the safe and efficient transfer of loads at sea by slewing pedestal cranes, such as commercially designed shipboard cargo cranes found on many vessels employed by the U.S. military for logistics missions.

The present invention represents a new methodology for controlling pendulation associated with motion of suspended payloads during operation of rotary boom (slewing pedestal) cranes. The present inventors style their invention "Pendulation Control System with Active Rider Block Tagline System" (abbreviated herein "PCS-with-ARBTS" or "PCS-w/ARBTS"), as it uniquely combines attributes of the two afore-discussed known systems, viz., the Rider Block Tagline System (RBTS) and the Pendulation Control System (PCS). The present invention was motivated in part by an Office of Naval Research (ONR) performance requirement calling for cargo transfer operations in sea-state 5.

Pendulation control analogous to that characterizing PCS is uniquely brought to bear by the present invention with respect to a stewing pedestal crane of the type that incorporates a rider block tagline system (RBTS). The present invention uniquely features active control of the rider block. The addition of this active control element permits the inverse kinematics (ship motion cancellation) commands to be optimally partitioned between the crane's primary and RBTS drive systems. Furthermore, the active swing damping commands can be fully implemented through the active rider block, thus entirely eliminating active swing damping as a requirement imposed on the primary crane drive system.

In accordance with typical embodiments of the present invention, shipboard rotary boom crane apparatus for hoisting a payload comprises a rotatable crane machinery housing, a boom, a rider block, a payload hoist line, a rider block lift line, a left rider block tagline, a right rider block tagline, a ship motion sensor, a payload swing sensor, at least six crane geometry sensors, and a computer program product.

A pedestal supports the crane machinery housing, to which the boom is attached. The crane machinery housing can rotate to affect the slewing of the boom. The boom is capable of luffing at a first end, and has a boom tip at a second end. The rider block is situated generally below the boom tip. The payload hoist line is adjustable in length and is reeved through the rider block. The rider block lift line, left rider block tagline, and right rider block tagline are each adjustable in length and are each attached to the rider block. The ship motion sensor is for measuring the six-degree-of-freedom (three linear and three rotational) motion of the ship. The payload swing sensor is for measuring the pendulation of the payload. The crane geometry sensors characterize the configuration of the crane. This characterization of crane configuration includes, but is not necessarily limited to: (i) the lengths, and rates of change of length (e.g., speed, velocity), of various lines; and, (ii) the angles, and rates of change of angle (e.g., rotational speed, angular velocity), of rotating joints. Terms (such as "speed," "velocity," "rate-of-change," "acceleration") that are used herein to refer to time-derivatives of crane geometric quantities—whether used relative to linear motion or rotational motion—are intended herein to synonymously represent the same or essentially the same physical quantities. The crane geometry/configuration can be characterized using a slew angle sensor, a luff angle sensor, a payload hoist-line length sensor, a rider block lift-line length sensor, a left rider-block tagline length sensor, and a right rider-block length tagline sensor. The slew angle sensor is for measuring the slew angle and slew angular velocity of the machinery housing relative to the pedestal. The luff angle sensor is for measuring the luff angle and luff angular velocity of the boom. The payload hoist line sensor is for measuring the length, and the rate-of-change of the length, of the payload hoist line. The rider block lift line sensor is for measuring the length, and the rate-of-change of the length, of the rider block lift line. The left rider block tagline sensor is for measuring the length, and the rate-of-change of the length, of the left rider block tagline. The right rider block tagline sensor is for measuring the length, and the rate-of-change of the length, of the right rider block tagline. The computer program product is for residence in the memory of a computer.

The computer program product comprises a computer-useable medium having computer program logic recorded thereon. The computer program logic includes means for processing input signals and means for transmitting output signals. The input signals include input signals received from the ship motion sensor, the payload swing sensor, and the crane geometry sensors. The means for processing includes means for calculating solutions pertaining to cancellation of the motion of the ship, and means for calculating solutions pertaining to damping of the pendulation of the payload. The output signals are based on the processing of the input signals. The output signals are for controlling the slew angle of the crane machinery housing, the luff angle of the boom, the length of the payload hoist line, the length of the rider block lift line, the length of the left tagline, and the length of the right tagline. According to some inventive embodiments, the crane includes an operator command device, the input signals include input signals received from the operator command device, and the means for processing includes means for calculating filtration of commands rendered via the operator command device by the operator of the crane.

According to frequent inventive practice, the crane includes a rotating crane machinery housing, a pivot device, a payload hoist line winch, a rider block lift line winch, a left tagline winch, and a right tagline winch. The rotating crane machinery housing is for changing the slew angle of the boom. Said rotation is accomplished by a slew gear assembly situated between the crane machinery housing and the pedestal. The pivot device is for changing the luff angle of the boom. The payload hoist line winch is for changing the length of the payload hoist line. The rider block lift line winch is for changing the length of the rider block lift line. The left rider block tagline winch is for changing the length of the left rider block tagline. The right rider block tagline winch is for changing the length of the right rider block tagline. The slew angle sensor is functionally connected with the rotating crane machinery housing. The luff angle sensor is functionally connected with the pivot device. The payload hoist line sensor is functionally connected with the payload hoist line winch. The rider block lift line sensor is functionally connected with the rider block lift line winch. The left rider block tagline sensor is functionally connected with the left rider block tagline winch. The right rider block tagline sensor is functionally connected with the right rider block tagline winch.

Inventive principles are applicable to diversely contextualized RBTS-equipped cranes, albeit inventive practice is especially propitious in association with shipboard cranes used for transferring cargo to other ships or to piers, especially large, pedestal-style, slewing boom cranes. The present invention admits of practice in association with any crane-type lifting device that carries a load using overhead lifting cables. Suitable crane-type lifting devices also include (but are not limited to) other shipboard crane types, such as traveling gantry cranes or double girder cranes.

Other objects, advantages and features of the present invention will become apparent from the following detailed description of the invention when considered in conjunction with the accompanying drawings.

BRIEF DESCRIPTION OF THE DRAWINGS

The present invention will now be described, by way of example, with reference to the accompanying drawings, wherein like numbers indicate the same or similar components, and wherein.

DETAILED DESCRIPTION OF THE INVENTION

Figure 1:
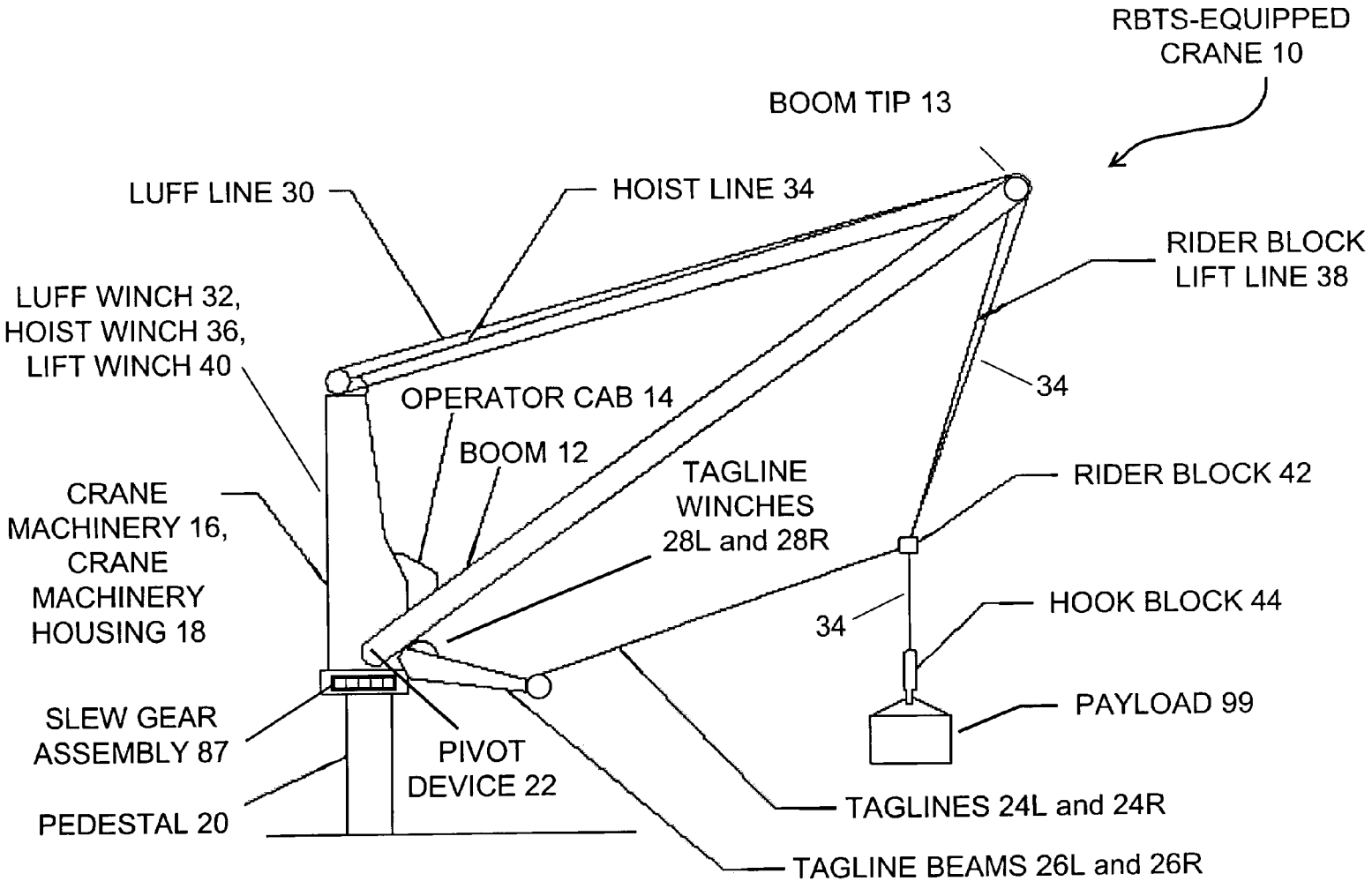
FIG. 1 is an elevation view of a crane equipped with a conventional Rider Block Tagline System (RBTS).

Reference is now made to FIG. 1, which shows an RBTS-equipped crane without the present invention's methodology applied thereto. Conventional RBTS-equipped crane 10 includes boom 12 (which includes a boom tip 13), operator cab 14, crane machinery 16, crane machinery housing 18, slew gear assembly 87, pedestal (base) 20, pivot device 22, taglines 24L and 24R, outriggers (tagline beams) 26L and 26R, tagline winches 28L and 28R, luff line 30, luff winch 32, payload hoist line 34, hoist winch 36, rider block lift line 38, lift winch 40, rider block 42, and hook block 44. Payload (load) 99 is suspended from hook block 44. The ordinarily skilled artisan understands that parts and components not indicated in FIG. 1 may also be included in RBTS-equipped crane 10. It is also understood that each of luff line 30, hoist line 34, and lift line 38, though nominally singularized herein, may actually include plural discrete linear structures such as wires or cables.

RBTS-equipped crane 10 is characterized by five degrees-of-freedom, namely: slew (horizontal rotational angle of boom 12 as determined by the horizontal rotation of crane machinery housing 18); luff (vertical rotational angle of boom 12, vertically rotatable about pivot device 22, via winching of luff line 30); hoist (vertical position of the payload 99, suspended from hook block 44, via winching of hoist line 34); horizontal position of rider block 34 (via coordinated/coupled winching of taglines 24L and 24R); and, vertical position of rider block 42 (via winching of rider block lift line 38). Change of the slew is effected via slew gear assembly 87, which is located in the vicinity of (e.g., between) the rotatable crane machinery housing 18 and the stationary pedestal 20, and which brings about rotation of crane machinery housing 18 relative to pedestal 20.

The crane operator (typically consisting of one person but possibly consisting of plural persons), situated in operator cab 14 of RBTS-equipped crane 10, manually controls (with electromechanical assistance) the following: the slew angle, using a handle functionally connected to crane machinery housing 18 to rotate crane machinery housing 18 relative to pedestal 20; the luff angle, using a handle functionally connected to luff winch 32 to wind/unwind luff line 30; the hoist length, using a handle functionally connected to hoist winch 36 to wind/unwind hoist line 34; the vertical position of rider block 42, using a foot-pedal functionally connected to lift winch 40 to wind/unwind lift line 38; the horizontal position of rider block 42, using a foot-pedal functionally connected to both left tagline winch 28L (situated at the end of left tagline beam 26L) and right tagline winch 28R (situated at the end of right tagline beam 26R) to wind/unwind, in parallel, single-control fashion, left tagline 24L and right tagline 24R. The lengths of the two taglines 24L and 24R and the rider block lift line 38 establish the position of the rider block 42.

Rider block 42, a sheave block through which hoist line 34 is reeved, can be positioned upward and downward between the boom tip 13 and the hook block 44 by the crane operator using rider block lift line 38. In addition, rider block 42 can be positioned inward (toward pedestal 20) and outward (away from pedestal 20) by the crane operator using a pair of taglines, viz., left tagline 24L and right tagline 24R, which run from rider block 42 to the ends of left outrigger 26L and right outrigger 26R, respectively, which are attached to the crane machinery housing 18 below the operator cab 14 and extend to the left and right sides, respectively, of boom 12. RBTS-equipped crane 10 is a "level-luffing" crane; that is, when the luff is changed, the hook block 44 remains at the same vertical height. However, when the luff is changed, rider block 42 does not remain at the same vertical height; rather, the distance between rider block 42 and boom tip 13 remains constant during luffing movements. Also, when the hoist 34 is changed, the vertical height of rider block 42 is not changed accordingly.

Naud et al. disclose in their aforementioned U.S. Pat. No. 6,039,193 a method for automatically controlling a crane's rider block lift line and taglines. Naud et al.'s method relieves the crane operator of the responsibility of manually controlling the horizontal and vertical positions of rider block 42. Regardless of whether the Naud et al. automation is implemented, no capability is designed or existent in RBTS-equipped crane 10 for independently adjusting the respective lengths of left tagline 24L and right tagline 24R. In the absence of practice of the present invention, the two taglines 24L and 24R are concurrently adjusted in length, at all times remaining equal to each other in length.

The three main objectives of an RBTS are to make possible the following: reduction of the pendulum length of the suspended load, thereby de-tuning the natural frequency of the swinging load from the natural roll period of the vessel; reduction of side loads on the crane boom that are due to out-of-plane movement of the suspended load; more rapid changing of the load radius on cranes, especially on cranes with slow boom-luff speeds. Although an RBTS is effective in improving payload control, its effectiveness is limited to relatively low ship-motion conditions. Moreover, since RBTS is a passive system, it is incapable of eliminating all payload pendulation. As RBTS neither contemplates nor accommodates the implementation of differential tagline lengths, it cannot affect cargo motions out of a plane parallel to the centerline of the boom. Furthermore, notwithstanding the oscillatory frequency de-tuning that RBTS is capable of accomplishing, the payload's motion remains coupled to the ship's motion.

Figure 2:
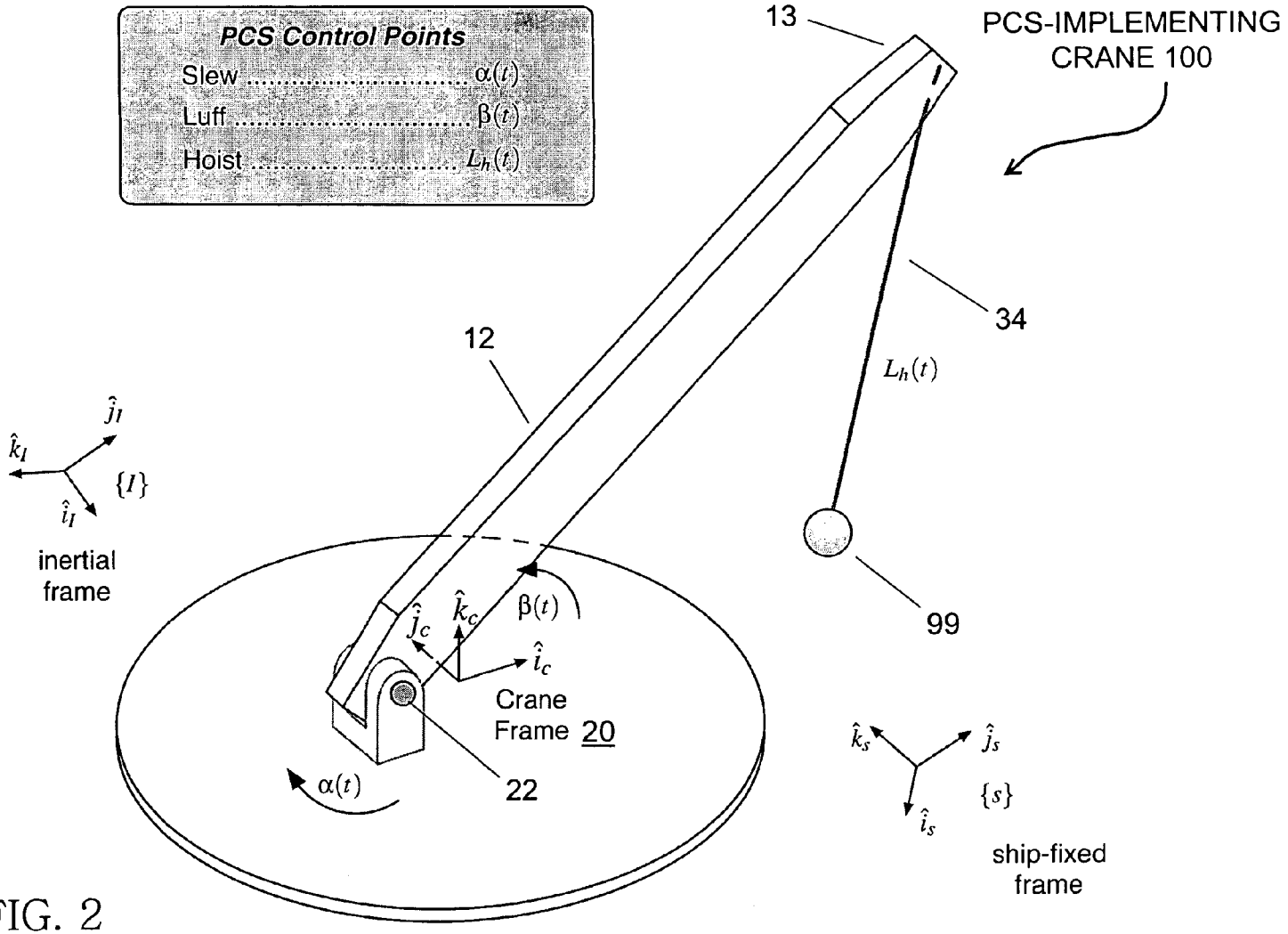
FIG. 2 is a perspective view of a simple crane implementing a conventional Pendulation Control System (PCS).

With reference to FIG. 2, PCS-implementing crane 100, disclosed by the aforementioned Agostini et al. 2002, is characterized by three degrees-of-freedom, namely: slew (horizontal rotational angle of boom 12 as determined by the horizontal rotation of crane machinery housing 18); luff (vertical rotational angle of boom 12, vertically rotatable about pivot device 22, e.g., via winching of a luff line not shown in FIG. 2); and, hoist (vertical position of the payload 99, e.g., suspended from a hook block not shown in FIG. 2, via winching of hoist line 34). The crane operator, situated in the operator cab (not shown in FIG. 2) of PCS-implementing crane 100, manually controls (with electromechanical assistance) the following: the slew, using a handle functionally connected to crane machinery housing 18 to rotate crane machinery housing 18; the luff, using a handle functionally connected to a luff winch (not shown in FIG. 2) to wind/unwind a luff line (not shown in FIG. 2); and, the hoist, using a handle functionally connected to a hoist winch (not shown in FIG. 2) to wind/unwind hoist line.

The Pendulation Control System (PCS) disclosed by Agostini et al. 2002 was designed to control—to an extent greater than the RBTS—the swinging motion of loads being handled by marine pedestal cranes in a dynamic environment. The performance goal of the PCS was at-anchor sea-state 3 capability. Agostini et al. 2002's PCS uses a ship motion sensor, a payload swing sensor, and crane geometry measurements, along with the crane operator's inputs, to calculate the appropriate crane motion commands. The PCS payload control strategy mitigates payload swing caused by three distinct sources, viz., ship motion, external transient disturbance forces and system imperfections, and operator commands. Agostini et al. 2002's algorithm includes three elements for addressing these sources, viz., ship motion compensation (cancellation), active swing damping, and operator command filtering.

Agostini et al. 2002's ship motion cancellation feature is an inverse kinematics algorithm that uses measured ship motion data and crane position data to provide crane machinery control signals that hold the payload steady in space, thus preventing ship motions from causing hazardous payload swinging. Active swing damping utilizes measured payload swing data and crane position data to eliminate pendulation that develops due to drive system and sensor imperfections, external forces, and flexibility in the crane structure. As shown in FIG. 2, Agostini et al. 2002's PCS avails itself of the standard crane actuator capabilities of slew $\alpha(t)$, luff $\beta(t)$, and hoist $L_h(t)$ to perform its ship motion cancellation and its active swing damping. The crane operator command inputs are adaptively filtered such that swing excitation frequency components in the command are not transmitted to the crane.

Much of the time during typical operation of a PCS-implementing crane 100, the ship on which the PCS-implementing crane 100 is mounted is characterized by less than three degrees of roll angle. Tests demonstrate that the PCS can hold payload motion to a 0.5 meter pendulation radius (the area in which the payload 99 swings in the horizontal geometric plane) for nearly 3° of roll angle. Nevertheless, there typically are times in which the ship is characterized by 3° of roll angle or greater. Tests demonstrate that as roll angles approach and exceed 30, the speed demands on the crane 100 machinery begin to exceed the capability of the crane 100 to respond, rapidly diminishing the PCS's effectiveness.

Now referring to FIG. 3 through FIG. 9, the pendulation control system in accordance with the present invention includes active control of a rider block tagline system with which the crane is equipped. The present invention's "PCS w/ARBTS" uniquely combines attributes of both the RBTS shown in FIG. 1 and the PCS shown in FIG. 2. The present invention's PCS-with-ARBTS-implementing crane 1000 shown in FIG. 3 through FIG. 5 includes basic crane equipment similar to that of the RBTS-equipped crane 10 shown in FIG. 1, but further includes combination therewith of the present invention's crane control methodology.

Figure 3:
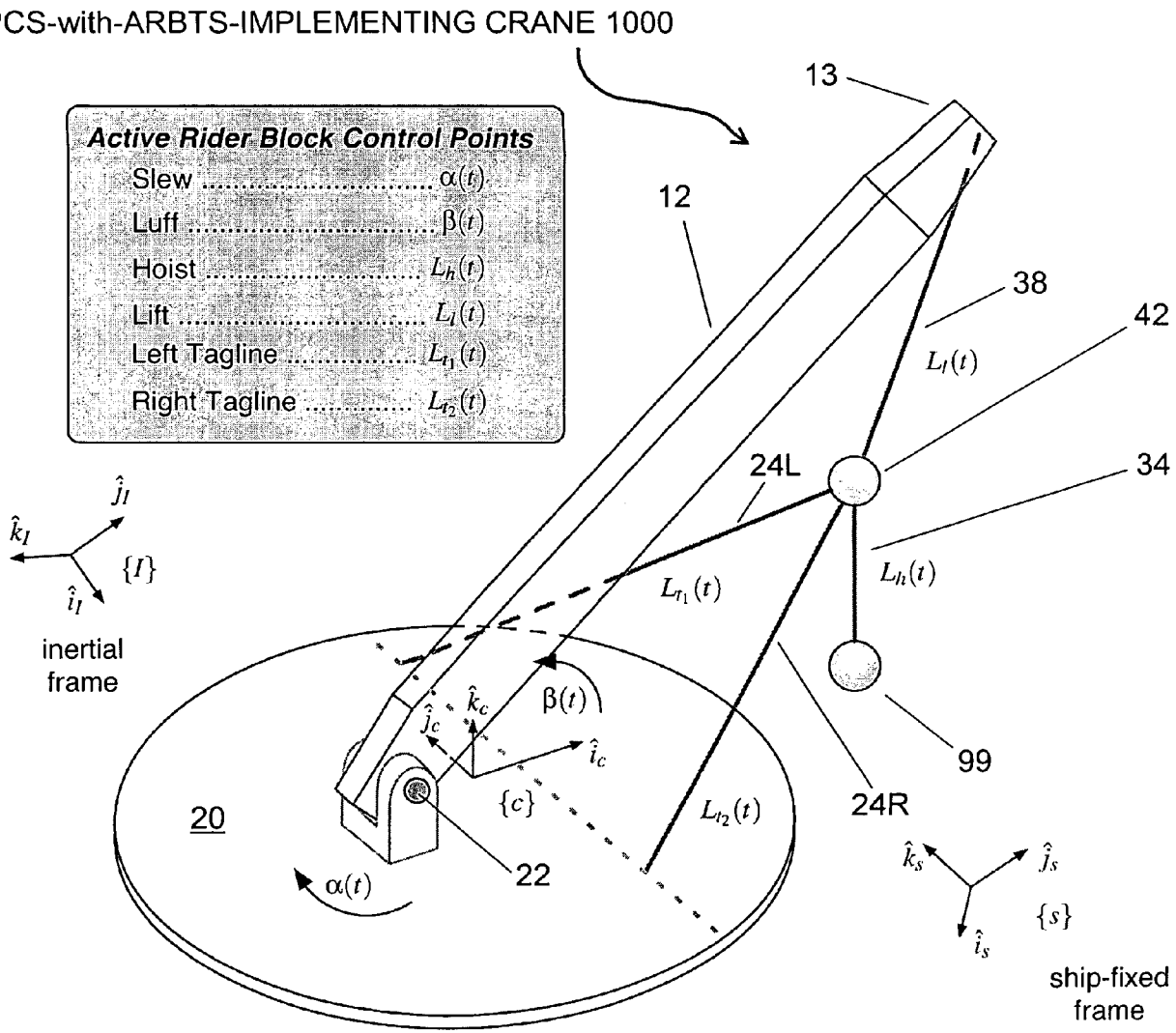
FIG. 3 is a perspective view of an embodiment of a crane implementing the present invention's "Pendulation Control System with Active Rider Block Tagline System" ("PCS with ARBTS").
Figure 4:
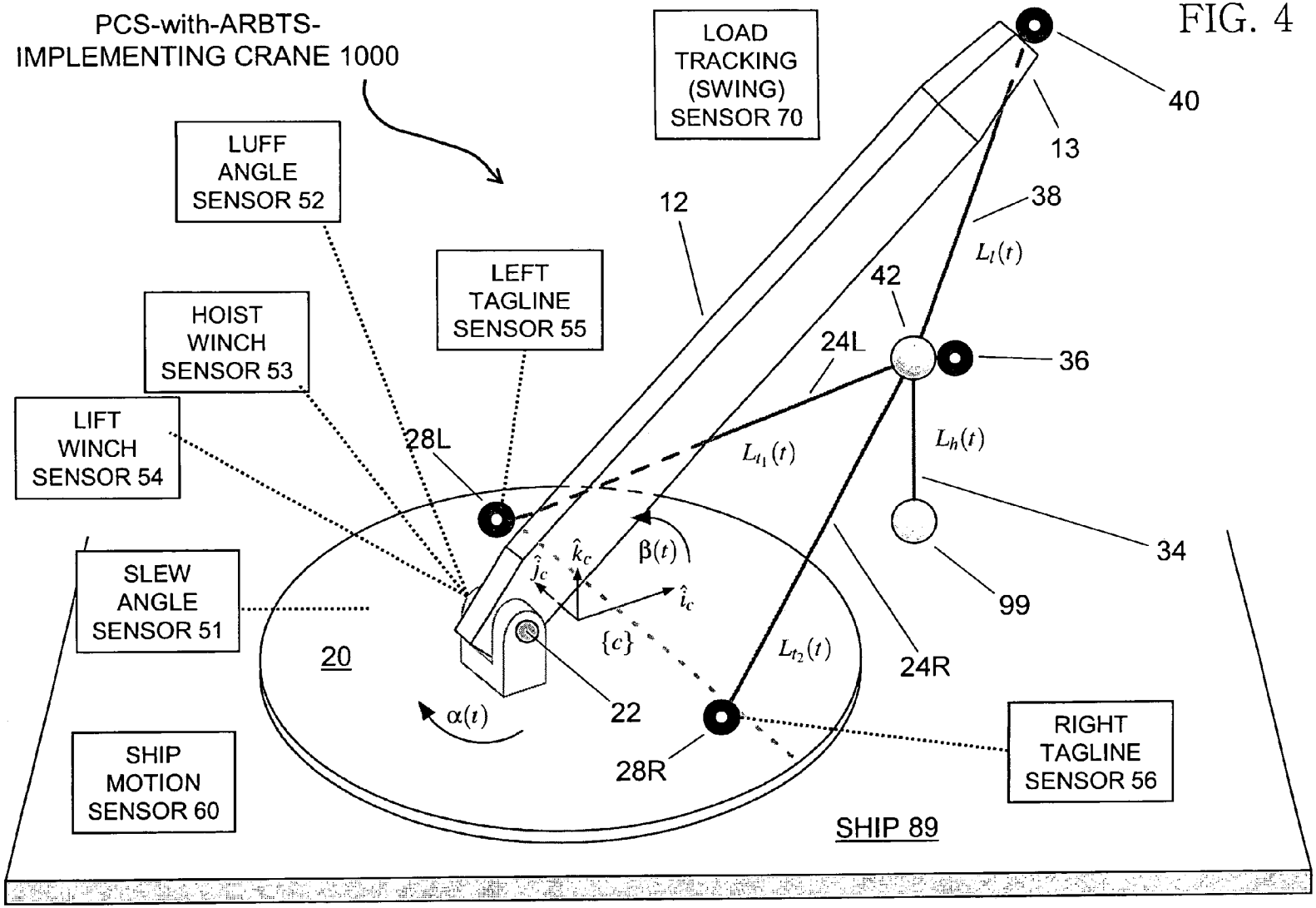
FIG. 4 is the view shown in FIG. 3 of a crane implementing the present invention's PCS with ARBTS, illustrating locations of various winches and sensors.
Figure 5:
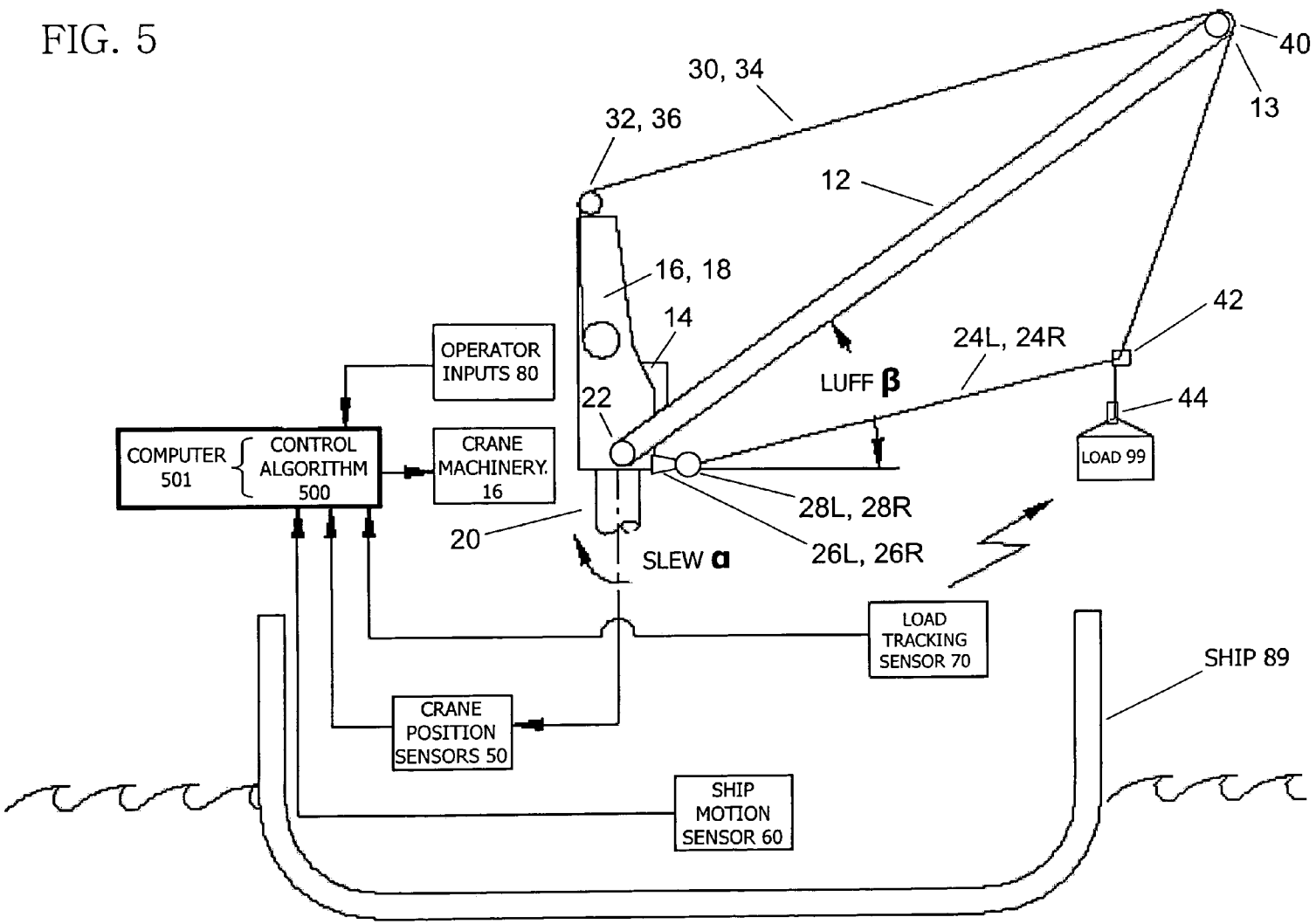
FIG. 5 is a schematic of an embodiment of the present invention's PCS with ARBTS, illustrating inputting of information from various sensors to the present invention's crane control algorithm resident in the memory of a computer.

Similar to the RBTS-equipped crane 10 shown in FIG. 1, inventive PCS-with-ARBTS-implementing crane 1000 shown in FIG. 3 through FIG. 5 includes boom 12 (which includes a boom tip 13), an operator cab 14, crane machinery 16, crane machinery housing 18, pedestal (base) 20, pivot device 22, taglines 24L and 24R, outriggers (tagline beams) 26L and 26R, tagline winches 28L and 28R, luff line 30, luff winch 32, payload hoist line 34, hoist winch 36, rider block lift line 38, lift winch 40, rider block 42, and hook block 44. Inventive crane 1000 is shown in FIG. 4 and FIG. 5 to be mounted on the deck of a waterborne ship 89.

PCS-implementing crane 100, shown in FIG. 2, is characterized by three control points, viz., slew $\alpha(t)$, luff $\beta(t)$, and hoist $L_h(t)$. In contrast, as shown in FIG. 3 through FIG. 6, the present invention's PCS-w/ARBTS-implementing crane 1000 is characterized by six control parameters, viz., slew angle $\alpha(t)$, luff angle $\beta(t)$, hoist length $L_h(t)$, rider block lift line length $L_1(t)$, left tagline length $L_{t1}(t)$, and right tagline length $L_{t2}(t)$. In other words, as compared with PCS-implementing crane 100, inventive PCS-w/ARBTS-implementing crane 1000 has three additional control parameters, namely, rider block lift line length $L_1(t)$, left tagline length $L_{t1}(t)$, and right tagline length $L_{t2}(t)$; these three additional control parameters are associated with the RBTS-related machinery and are constituents of the "active" RBTS aspect of the present invention.

Figure 6:
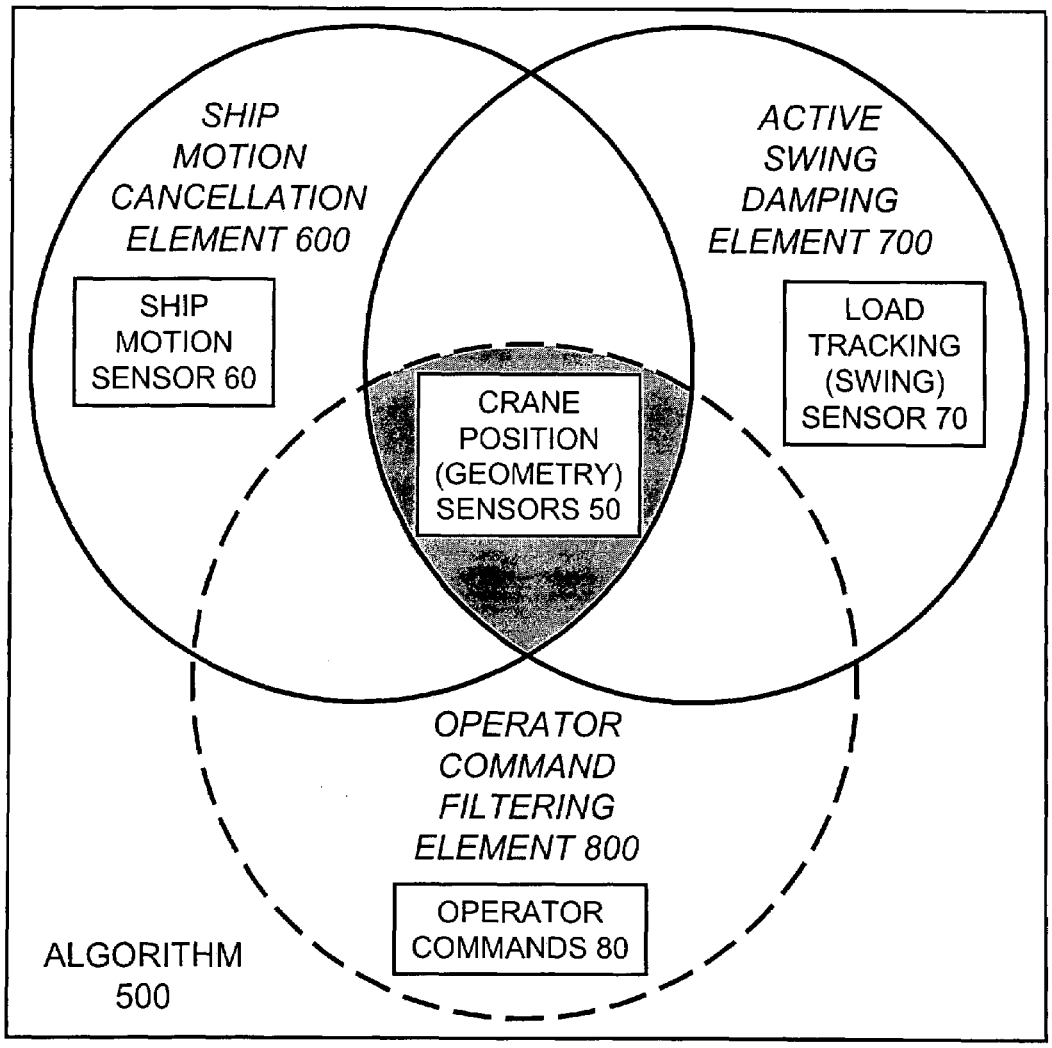
FIG. 6 is a Venn-type diagram of an embodiment of the present invention's PCS with ARBTS, illustrating the sensory informational intersection of the two (or three) main pendulation-mitigating processes of the present invention's crane control algorithm.

In a manner analogous to Agostini et al. 2002's PCS, the present invention's PCS w/ARBTS blends various control elements, each control element being associated with various sensory means. FIG. 6 illustrates the intersection of ship motion cancellation element 600, the active swing damping element 700, and the operator command filtering element 800. Each of these three system elements makes use of six combined crane sensors (synonymously referred to herein as crane geometry sensors) 50 capable of providing a reference absolute position as well as incremental or rate of motion information, shown in FIG. 4 through FIG. 6. Ship motion cancellation element 600 avails itself of six crane position sensors 50 and a ship motion sensor 60. Active swing damping element 700 avails itself of six crane geometry sensors 50 and a load tracking sensor (synonymously referred to herein as a swing sensor) 70. According to some inventive embodiments, active swing damping element 700 is associated with the three RBTS-related geometry sensors 50 (rider block lift line length sensor 54, rider block left tagline length sensor 55, rider block right tagline length sensor 56).

Ship motion sensor 60 can include, for instance, an inertial measuring device situated on ship 89 (e.g., proximate crane base 20) to measure the sea-induced motion of ship 89 (which represents the base of inventive crane 1000) in terms of six degrees of freedom, viz., roll, pitch, yaw, heave, surge, and sway. The three kinds of translational ship motion are heave (linear movement along a vertical axis), surge (linear movement along a horizontal fore-and-aft axis), and sway (linear movement along a horizontal port-and-starboard axis); the three kinds of rotational ship motion are roll (rotational movement about a horizontal fore-and-aft axis), pitch (rotational movement about a horizontal port-and-starboard axis), and yaw (rotational movement about a vertical axis).

Swing sensor 70 can include a device for measuring (i) the position of rider block 42, (ii) the position of hook block 44, and (iii) the relationship in three dimensions between (i) the rider block 42 position and (ii) the hook block 44 position. Due to the inclusion of the rider block 42 and related components, a swing sensor 70 system suitable for inventive practice will typically be more complicated than the swing sensor 70 system disclosed by Agostini et al. 2002 with regard to PCS, wherein straightness can be assumed of the hoist cables 34 between the boom tip 13 and the hook block 44. According to usual inventive practice, swing sensor 70 can involve technologies including, but not limited to, Real Time Kinematic Global Positioning System (RTK GPS), ultrawideband rangefinding radio(s), laser beacon(s), accelerometer(s), angular deflection-measuring resolver(s), or combination(s) thereof. An RTK GPS, an ultrawideband system, or a laser beacon system can each include a network of sensors located, for instance, on or near the crane house 18, the crane boom 12, the rider block 42, the hook block 44, and/or the vessel 89. Accelerometers mounted on the rider block 42 and the hook block 44 can be used to estimate the motions of each. Angular deflection-measuring resolvers located at the boom tip 13 and the rider block 42 can estimate relative positions between the rider block 42 and the hook block 44 by measuring the angular deflection of the hoist cables 34 below the boom tip 13 and the rider block 42.

Figure 7:
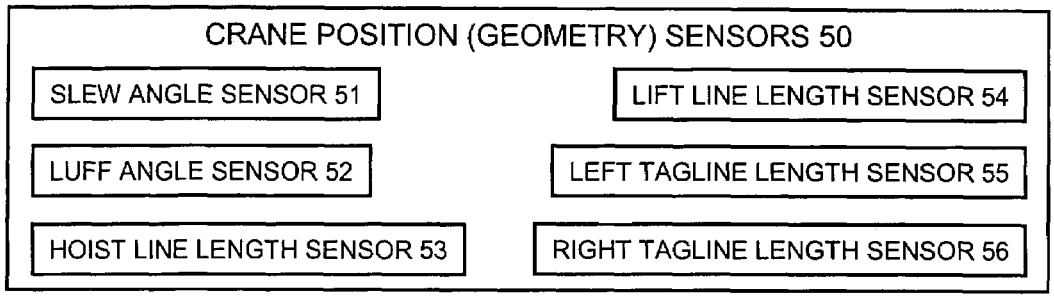
FIG. 7 is a diagrammatic box specifying six different kinds of crane geometry sensors, which are (or are among) the crane geometry sensors categorically indicated in FIG. 6.

As shown in FIG. 4 and FIG. 7, crane position sensors 50 include the following: slew angle $\alpha(t)$ sensor 51, which is associated with the rotating of the crane machinery housing 18 in relation to the stationary pedestal 20; luff angle $\beta(t)$ sensor 52, which is associated with pivoting device 22; hoist length $L_h(t)$ winch sensor 53, which is associated with hoist winch 36; rider block 42 lift line length $L_1(t)$ winch sensor 54, which is associated with lift winch 40; left tagline length $L_1(t)$ winch sensor 55, which is associated with left tagline winch 28L; and, right tagline length $L_{t2}(t)$ winch sensor 56, which is associated with right tagline winch 28R. Both absolute position and speed are required for slew, luff, hoist, rider block lift line, right tagline, and left tagline. Each crane position sensor is capable of providing a reference position as well as rate-of-motion information, for instance through the use of a combination of absolute and incremental optical encoders attached to the crane machinery, luff winch 32, hoist winch 36, lift winch 40, tagline winches 28L and 28R, and crane machinery housing 18 slew gear.

Analogously as featured by the PCS disclosed by Agostini et al. 2002, some embodiments of the present invention feature all three system control elements, viz., an inverse kinematics ship motion cancellation element 600, a swing damping element 700, and an operator command filtering element 800. Generally, however, operator command filtering tends to be less important to inventive practice than are ship motion cancellation and swing damping. Therefore, the present invention can often be efficaciously practiced inclusive of a ship motion cancellation element 600 and a swing damping element 700, but exclusive of an operator command filtering element 800.

As illustrated in FIG. 5, the present invention's crane control algorithm 500, resident in a computer (e.g., processor-controller) 501, includes the ship motion cancellation element 600, the active swing damping element 700, and the operator command filtering element 800. The term "computer" as used herein broadly refers to any machine having a memory. According to typical inventive practice, a computer 501 is capable of receiving, processing, and transmitting electrical signals. The term "sensor" as used herein broadly refers to any device that is capable of "sensing" something, such as "measuring" a physical quantity; that is, a sensor is any device that is capable of responding to a physical stimulus or physical stimuli so as to transmit an electrical signal that can be interpreted in a way that provides information (e.g., measurement information) pertaining to the physical stimulus or physical stimuli, such information being useful, for instance, for measurement and/or control purposes. Ship motion cancellation element 600 receives input from the crane geometry sensors 50 and the ship motion sensor 60. Active swing damping element 700 receives input from the crane geometry sensors 50 and the swing sensor 70. Operator command filtering element 800 receives input from the crane geometry sensors 50 and the operator commands 80.

The operator commands 80 box shown in FIG. 5 diagrammatically represents the devices used by the operator to manually adjust the geometry of the crane. The operator commands 80 are signals originating from the operator who is situated in cab 14 and manipulates various handles, pedals, or buttons for exercising a degree of geometric control of the crane. For typical inventive embodiments, operator commands 80 include manual commands of the operator pertaining to slew, luff, hoist, rider block lift line, left tagline, and right tagline. For some inventive embodiments, operator commands 80 include (i) manual commands of the operator pertaining to slew, luff and hoist, and (ii) automatic commands pertaining to lift, left tagline, and right tagline in accordance with the aforementioned Naud et al. U.S. Pat. No. 6,039,193.

On a continual, feedback-control loop basis, inventive computer 501 processes these inputs and transmits, to the crane 1000 machinery 16, signals that tend to maintain steadiness, in a three-dimensional frame of reference oriented to the local gravity vector and constrained to translate in inertial space with the ship 89, of payload 99. Crane machinery 16 includes the same electromechanical devices with which the crane geometry sensors 50 are associated, viz., rotating machinery housing 18 relative to pedestal 20, pivoting device 22, hoist winch 36, lift winch 40, left tagline winch 28L, and right tagline winch 28R. The inventive algorithmic control signals are thus transmitted, directly or indirectly, to the electromechanical devices that are capable of affecting the geometry of the crane.

Figure 8:
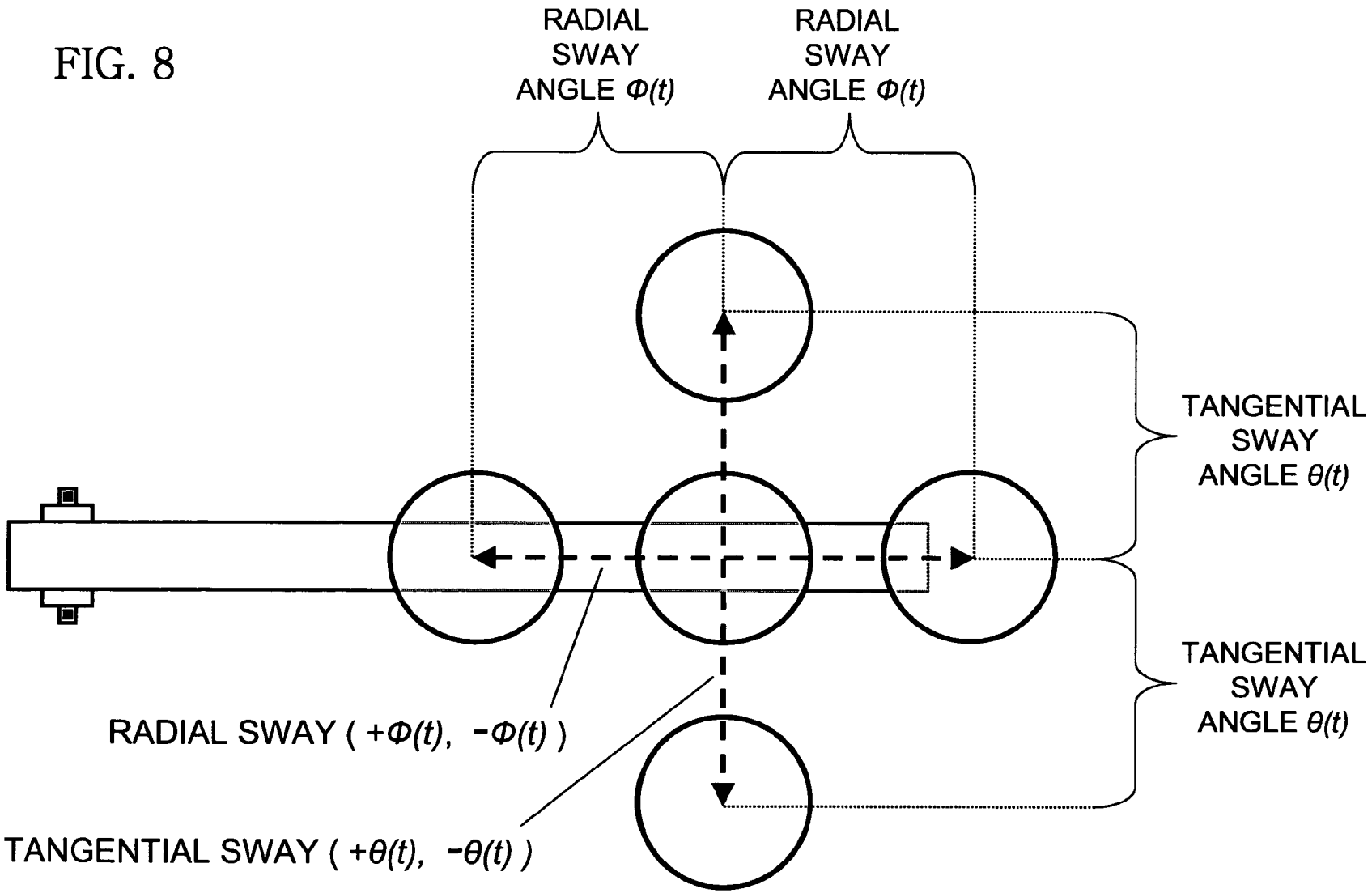
FIG. 8 is a simplified representative plan view of a crane implementing the present invention's PCS with ARBTS, diagrammatically illustrating tangential sway and radial sway of a pendulating payload.

As depicted in FIG. 8, inventive algorithm 500 considers the swinging (pendulation) of payload 99 in terms of radial sway (which is in a direction along the vertical geometric plane passing through boom 12) and tangential sway (which is in a direction along a vertical geometric plane that is perpendicular to the vertical geometric plane passing through boom 12), with the overall objective of minimizing the tangential sway angle $\theta$ and the radial sway angle $\Phi$. The ship motion cancellation element 600 is the primary hazard-prevention element, utilizing measured data from ship motion sensor 60 and crane geometry sensors 50 to prevent ship 89 motions from causing dangerously extreme swinging of payload 99. The active swing damping element 700 utilizes measured data from payload swing sensor 70 and crane geometry sensors 50 to eliminate pendulation that develops due to drive system imperfections, sensor imperfections, external forces (e.g., wind), and/or flexibility in the crane structure. The operator command filtering element 800 smoothes out the crane operator's control inputs, adaptively filtering them in such a way that swing excitation frequency components in the command are not transmitted to the crane.

The present invention's "active" RBTS, which uniquely combines PCS-like control with standard RBTS equipment such as shown in FIG. 1, affords two especially notable benefits. The first benefit, afforded not only by the present invention's PCS-with-ARBTS but also by the standard RBTS shown in FIG. 1, relates to reduction in pendulum length; that is, by reducing the pendulum length, the pendulum frequency is increased well above the roll frequency of the ship, greatly reducing payload swing excitation caused by ship motions.

The second benefit, uniquely afforded by the present invention's PCS-with-ARBTS, is concomitant the present invention's increased number and diversification of crane system control points. In particular, both ship motion cancellation element 600 commands and active swing damping element 700 commands are "spread around," i.e., more widely distributed, both qualitatively and quantitatively. The control points are "off-loaded" to some extent from the three "primary" crane control points (slew gear as associated with rotating crane machinery housing 18; luff winch 32 as associated with pivoting device 22; hoist winch 36 as associated with hoist line 34) to the three RBTS control points (rider block lift line winch 40 as associated with lift line 34; left tagline winch 28L as associated with left tagline 24L; right tagline winch 28R as associated with right tagline 24R). Since the control points are more evenly distributed across the entire crane system, the crane drive system requirements can commensurately be more evenly distributed across the entire crane system; this is particularly important for accommodating operations up to and including sea state 5. The present inventions allows for active control of the payload in elevated ship motion conditions without requiring crane machinery performance beyond that which is available in standard marine crane design.

The previous systems described herein with reference to FIG. 1 and FIG. 2 are limited in terms of capability and performance. The RBTS (shown in FIG. 1) succeeds in substantially reducing uncontrolled payload swing, but cannot provide direct payload control. The PCS (shown in FIG. 2) provides direct payload control, but is limited in its potential due to performance limitation of the crane machinery. The present invention's PCS-with-ARBTS greatly reduces the requirements on the crane machinery, thus permitting improved performance and a greater operational envelope.

The present inventors used computer simulation to compare the standard PCS shown in FIG. 2 with the inventive PCS-with-ARBTS, and thus demonstrated that a significant reduction in required drive speeds was provided by the inventive PCS-with-ARBTS. With respect to both the PCS-implementing crane 100 and the present invention's PCS-with-ARBTS-implementing crane 1000, the maximum speed requirements for the slew, luff, and hoist drive systems were obtained for the crane's entire workspace. It was found that the present invention's effectuation of an active rider block reduced all speed requirements. Of particular note, the maximum luff rate had an approximately eighty percent reduction. The maximum slew rate was reduced by approximately sixty percent. The maximum hoist rate was reduced only slightly, but the workspace area over which the maximum hoist rate was required was significantly reduced.

Figure 9:
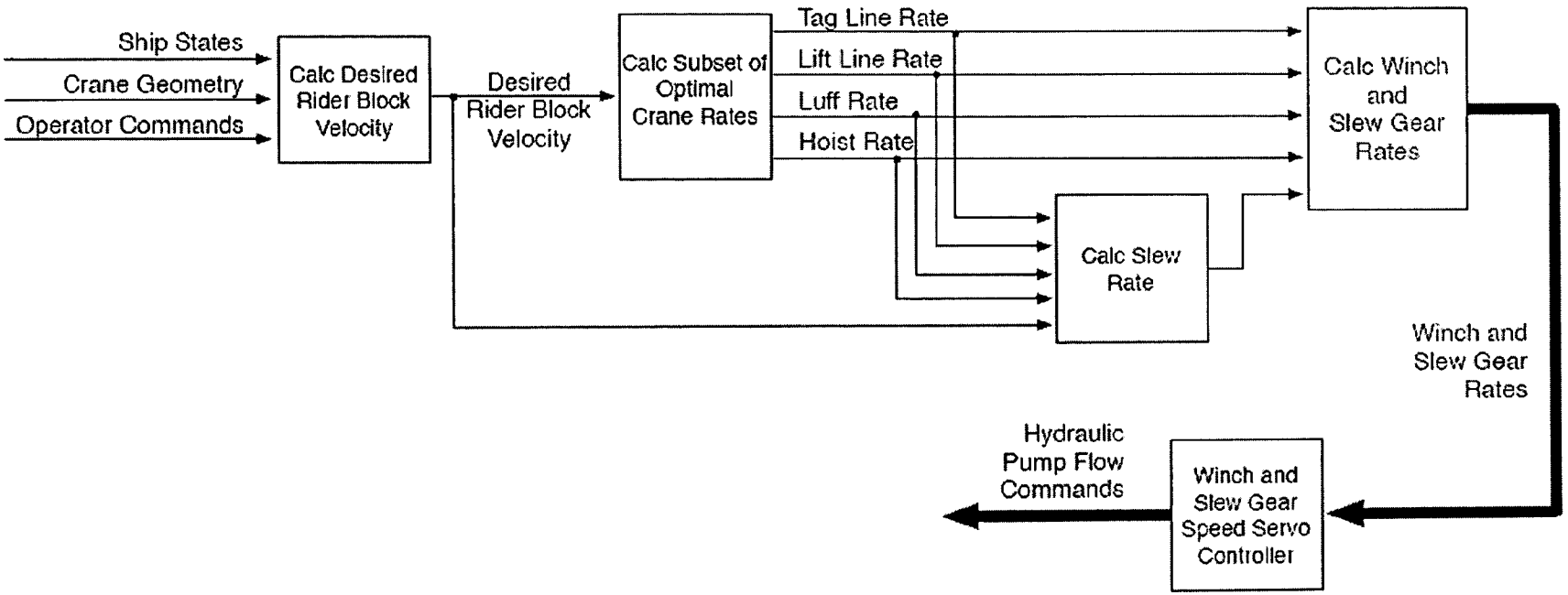
FIG. 9 is a schematic of an embodiment of the control logic of the present invention's crane control algorithm.

Reference is now made to FIG. 9, which schematically illustrates algorithmic control logic characterizing a computer program product 500 resident in a computer 501, in accordance with typical inventive practice. The four types of data required by the system are shown as inputs: ship states (ship motion measurements); crane geometry (slew angle and rate, luff angle and rate, rider block height and rate, hook height and rate, tagline lengths and rates); operator commands; and, payload motion. This data is processed and the desired rider block velocity calculated. This velocity is used in a subset of the algorithm to calculate desired rates for each of the control points. These rates are then translated into rates for the winches and slew gears. These winch and slew gear rates are then fed to the crane's speed control mechanism, which issues commands to the crane machinery. These commands are implemented by the crane, which in turn affects the original system inputs.

The present invention, which is disclosed herein, is not to be limited by the embodiments described or illustrated herein, which are given by way of example and not of limitation. Other embodiments of the present invention will be apparent to those skilled in the art from a consideration of the instant disclosure or from practice of the present invention. Various omissions, modifications and changes to the principles disclosed herein may be made by one skilled in the art without departing from the true scope and spirit of the present invention, which is indicated by the following claims.

What is claimed is:

1. A system for use in association with a rotary boom crane situated onboard a ship and capable of hoisting a payload, said crane including a boom, a payload hoist line, a rider block, a rider block lift line, a left rider block tagline, and a right rider block tagline, said apparatus comprising:

a ship motion sensor for measuring the motion of said ship;

a payload swing sensor for measuring the pendulation of said payload;

plural crane geometry sensors including:

a slew angle sensor for measuring the slew angle and slew-angular rotation rate of said boom;

a luff angle sensor for measuring the luff angle and luff-angular rotation rate of said boom;

a payload hoist line sensor for measuring the length and rate-of-change-of-length of said payload hoist line;

a rider block lift line sensor for measuring the length and rate-of-change-of-length of said rider block lift line;

a left rider block tagline sensor for measuring the length and rate-of-change-of-length of said left rider block tagline;

a right rider block tagline sensor for measuring the length and rate-of-change-of-length of said right rider block tagline;

a computer program product for residence in the memory of a computer, said computer program product comprising a computer-useable medium having computer program logic recorded thereon, said computer program logic including:

means for processing input signals, said input signals including input signals received from said ship motion sensor, said payload swing sensor, and said crane geometry sensors, said means for processing including means for calculating solutions pertaining to cancellation of the motion of said ship and means for calculating solutions pertaining to damping of the pendulation of said payload;

means for transmitting output signals, said output signals being based on said processing of said input signals, said output signals being for controlling the slew angle of said boom, the luff angle of said boom, the length of said payload hoist line, the length of said rider block lift line, the length of said left tagline, and the length of said right tagline.

2. The system of claim 1, wherein the motion of said ship is related to the waterborne state of said ship, and wherein said ship motion sensor is for measuring the motion of said ship so as to account for roll, pitch, yaw, heave, surge, and sway of said ship.

3. The system of claim 1, said crane further including an operator command device, said input signals further including input signals received from said operator command device, said means for processing further including means for calculating filtration of commands rendered via said operator command device by the operator of said crane.

4. The system of claim 1, said crane further including a rotating housing, a pivot device, a payload hoist line winch, a rider block lift line winch, a left tagline winch, and a right tagline winch, wherein:

said rotating housing is for changing the slew angle of said boom;

said pivot device is for changing the luff angle of said boom;

said payload hoist line winch is for changing the length of said payload hoist line;

said rider block lift line winch is for changing the length of said rider block lift line;

said left rider block tagline winch is for changing the length of said left rider block tagline;

said right rider block tagline winch is for changing the length of said right rider block tagline;

said slew angle sensor is for functional connection with said rotating housing;

said luff angle sensor is for functional connection with said pivot device;

said payload hoist line sensor is for functional connection with said payload hoist line winch;

said rider block lift line sensor is for functional connection with said rider block lift line winch;

said left rider block tagline sensor is for functional connection with said left rider block tagline winch;

said right rider block tagline sensor is for functional connection with said right rider block tagline winch.

5. The system of claim 4, said crane further including an operator command device, said input signals further including input signals received from said operator command device, said means for processing further including means for calculating filtration of commands rendered via said operator command device by the operator of said crane.

6. Shipboard rotary boom crane apparatus for hoisting a payload, said apparatus comprising:

a boom, said boom being capable of slewing and luffing at a first end and having a boom tip at a second end;

a rider block, said rider block being situated generally below said boom tip;

a payload hoist line, said payload hoist line being adjustable in length and being reeved through said rider block;

a rider block lift line, said rider block lift line being adjustable in length and being attached to said rider block;

a left rider block tagline, said left rider block tagline being adjustable in length and being attached to said rider block;

a right rider block tagline, said right rider block tagline being adjustable in length and being attached to said rider block;

a ship motion sensor, said ship motion sensor being for measuring the motion of said ship;

a payload swing sensor, said payload swing sensor being for measuring the pendulation of said payload;

plural crane geometry sensors, said crane geometry sensors including a slew angle sensor, a luff angle sensor, a payload hoist line sensor, a rider block lift line sensor, a left rider block tagline sensor, and a right rider block tagline sensor, said slew angle sensor being for measuring the slew angle and slew-angular rate of said boom, said luff angle sensor being for measuring the luff angle and luff-angular rate of said boom, said payload hoist line sensor being for measuring the length and rate-of-change-of-length of said payload hoist line, said rider block lift line sensor being for measuring the length and rate-of-change-of-length of said rider block lift line, said left rider block tagline sensor being for measuring the length and rate-of-change-of-length of said left rider block tagline, said right rider block tagline sensor for measuring the length and rate-of-change-of-length of said right rider block tagline;

a computer program product for residence in the memory of a computer, said computer program product comprising a computer-useable medium having computer program logic recorded thereon, said computer program logic including means for processing input signals and means for transmitting output signals, said input signals including input signals received from said ship motion sensor, said payload swing sensor, and said crane geometry sensors, said means for processing including means for calculating solutions pertaining to cancellation of the motion of said ship and means for calculating solutions pertaining to damping of the pendulation of said payload, said output signals being based on said processing of said input signals, said output signals being for controlling the slew angle of said boom, the luff angle of said boom, the length of said payload hoist line, the length of said rider block lift line, the length of said left tagline, and the length of said right tagline.

7. The apparatus of claim 6, wherein the motion of said ship is related to the waterborne state of said ship, and wherein said ship motion sensor is for measuring the motion of said ship so as to account for roll, pitch, yaw, heave, surge, and sway of said ship.

8. The apparatus of claim 6, said crane including an operator command device, said input signals including input signals received from said operator command device, said means for processing including means for calculating filtration of commands rendered via said operator command device by the operator of said crane.

9. The apparatus of claim 6, said crane including a rotating crane machinery housing, a pivot device, a payload hoist line winch, a rider block lift line winch, a left tagline winch, and a right tagline winch, wherein:

said rotating crane machinery housing is for changing the slew angle of said boom;

said pivot device is for changing the luff angle of said boom;

said payload hoist line winch is for changing the length of said payload hoist line;

said rider block lift line winch is for changing the length of said rider block lift line;

said left rider block tagline winch is for changing the length of said left rider block tagline;

said right rider block tagline winch is for changing the length of said right rider block tagline;

said slew angle sensor is functionally connected with said rotating crane machinery housing;

said luff angle sensor is functionally connected with said pivot device;

said payload hoist line sensor is functionally connected with said payload hoist line winch;

said rider block lift line sensor is functionally connected with said rider block lift line winch;

said left rider block tagline sensor is functionally connected with said left rider block tagline winch;

said right rider block tagline sensor is functionally connected with said right rider block tagline winch.

10. The apparatus of claim 9, said crane including an operator command device, said input signals including input signals received from said operator command device, said means for processing including means for calculating filtration of commands rendered via said operator command device by the operator of said crane.

* * * * *